US009101189B2

(12) United States Patent
Vuckov

(10) Patent No.: US 9,101,189 B2
(45) Date of Patent: Aug. 11, 2015

(54) APPARATUS FOR RETAINING A POWER TOOL

(71) Applicant: Rudolph P. Vuckov, Royal Oak, MI (US)

(72) Inventor: Rudolph P. Vuckov, Royal Oak, MI (US)

( * ) Notice: Subject to any disclaimer, the term of this patent is extended or adjusted under 35 U.S.C. 154(b) by 112 days.

(21) Appl. No.: 13/896,469

(22) Filed: May 17, 2013

(65) Prior Publication Data

US 2013/0306690 A1 Nov. 21, 2013

Related U.S. Application Data

(60) Provisional application No. 61/648,712, filed on May 18, 2012.

(51) Int. Cl.

| | |
|---|---|
| ***A45F 5/00*** | (2006.01) |
| ***A45C 11/00*** | (2006.01) |
| ***A45F 5/02*** | (2006.01) |
| ***B25H 3/00*** | (2006.01) |

(52) U.S. Cl.

CPC ..... *A45C 11/00* (2013.01); *A45F 5/021* (2013.01); *B25H 3/00* (2013.01); *A45F 2200/0575* (2013.01)

(58) Field of Classification Search

CPC .... B25H 3/006; Y10S 224/904; A45C 11/00; A45F 5/021; A45F 2200/0575

USPC ..... 224/197, 904, 242, 268

See application file for complete search history.

(56) References Cited

U.S. PATENT DOCUMENTS

| | | | | |
|---|---|---|---|---|
| 894,569 | A | 7/1908 | Batchelder | |
| 2,765,107 | A * | 10/1956 | Browning | 224/255 |
| 3,212,688 | A * | 10/1965 | Lane | 224/247 |
| 3,343,735 | A * | 9/1967 | Breeding et al. | 224/242 |
| 3,942,692 | A | 3/1976 | Chica | |
| 4,079,870 | A | 3/1978 | Clark | |
| 4,223,820 | A | 9/1980 | Vorsanger et al. | |
| D270,929 | S | 10/1983 | Shasteen et al. | |
| 4,480,776 | A | 11/1984 | Atkins, Sr. | |
| 5,609,283 | A * | 3/1997 | Harrison, Jr. | 224/678 |
| 5,984,046 | A | 11/1999 | Urso, Jr. | |
| 6,102,264 | A * | 8/2000 | Redzisz | 224/197 |
| 6,561,402 | B2 | 5/2003 | Holland et al. | |
| 6,585,209 | B1 * | 7/2003 | Mattingly | 248/309.1 |
| 6,601,674 | B2 | 8/2003 | Murray | |
| 6,729,480 | B1 | 5/2004 | Blake | |
| 6,892,914 | B2 | 5/2005 | Girbert | |
| 2003/0015560 | A1 * | 1/2003 | Grover | 224/247 |
| 2008/0035590 | A1 * | 2/2008 | Huang | 211/70.6 |
| 2009/0026155 | A1 * | 1/2009 | Bernard | 211/70.6 |
| 2009/0314813 | A1 | 12/2009 | Woolery | |
| 2011/0073343 | A1 | 3/2011 | Sawano et al. | |

FOREIGN PATENT DOCUMENTS

| | | |
|---|---|---|
| EP | 1155783 | 4/2006 |
| EP | 1655114 | 7/2006 |

* cited by examiner

*Primary Examiner* — Adam Waggenspack
(74) *Attorney, Agent, or Firm* — Vincent Re PLLC

(57) ABSTRACT

A holster device for securely holding a tool can include a stationary retention feature and a sliding retention member securing a first portion of the tool and pressing a second portion of the tool against the stationary retention feature. The tool is retained to the holster device between the stationary retention feature and the sliding retention member. The holster device can be configured such that a force applied to the tool moves the sliding retention member away from the stationary retention feature and releases the tool from the holster device.

10 Claims, 9 Drawing Sheets

APPARATUS FOR RETAINING A POWER TOOL

CROSS REFERENCE TO RELATED APPLICATIONS

This disclosure claims the benefit of U.S. Provisional Application No. 61/648,712 filed on May 18, 2012 which is hereby incorporated by reference.

TECHNICAL FIELD

This disclosure is related to use of a power tool and retaining the power tool in a convenient location to the user of the power tool.

BACKGROUND

The statements in this section merely provide background information related to the present disclosure. Accordingly, such statements are not intended to constitute an admission of prior art.

People use power tools in a wide variety of applications and tasks. A task can include a single operation, wherein a power tool is used one time to perform a single operation. A task can include a complex set of operations using a wide variety of power tools for a number of purposes. A single power tool can be refitted with a different tip, bit, or other instrument known in the art to perform different operations with the same power tool.

A wide variety of power tools are known in the art. Hand-held drills or drills provide torsional power to a shaft connected to a bit. Drill bits can include a wide variety of specialized features, wherein the drill bit is configured to create an exemplary hole in particular material or range of materials. Drills can also be fit with a bit configured to engage an end of a fastener, such as a screw or bolt, with torque from the drill being used through the bit to turn the fastener. Similar hand-held tools can include other bits configured to cut, saw, mill, grind, sand, buff, or otherwise remove material from a workpiece. Similar hand-held tools can include a nail-driver, tack-driver, or similar device, wherein activation of the tool provides a fastener with a driving force from an end of the tool. Tools can be electrically powered, either through a wired connection to a power source or through a battery pack attached to the tool. Tools can be pneumatically powered, with pressurized air being supplied through a supply line attached to the tool. A wide variety of hand-held tools with a variety of methods to power the various tools are known in the art, and the disclosure is not intended to be limited to the particular exemplary embodiments provided herein.

A tool may be held within a holster device. A holster device can securely store the tool within easy reach of the worker until the tool is needed.

SUMMARY

A holster device for securely holding a tool can include a stationary retention feature and a sliding retention member securing a first portion of the tool and pressing a second portion of the tool against the stationary retention feature. The tool is retained to the holster device between the stationary retention feature and the sliding retention member. The holster device can be configured such that a force applied to the tool moves the sliding retention member away from the stationary retention feature and releases the tool from the holster device.

BRIEF DESCRIPTION OF THE DRAWINGS

One or more embodiments will now be described, by way of example, with reference to the accompanying drawings, in which.

DETAILED DESCRIPTION

Figure 1:
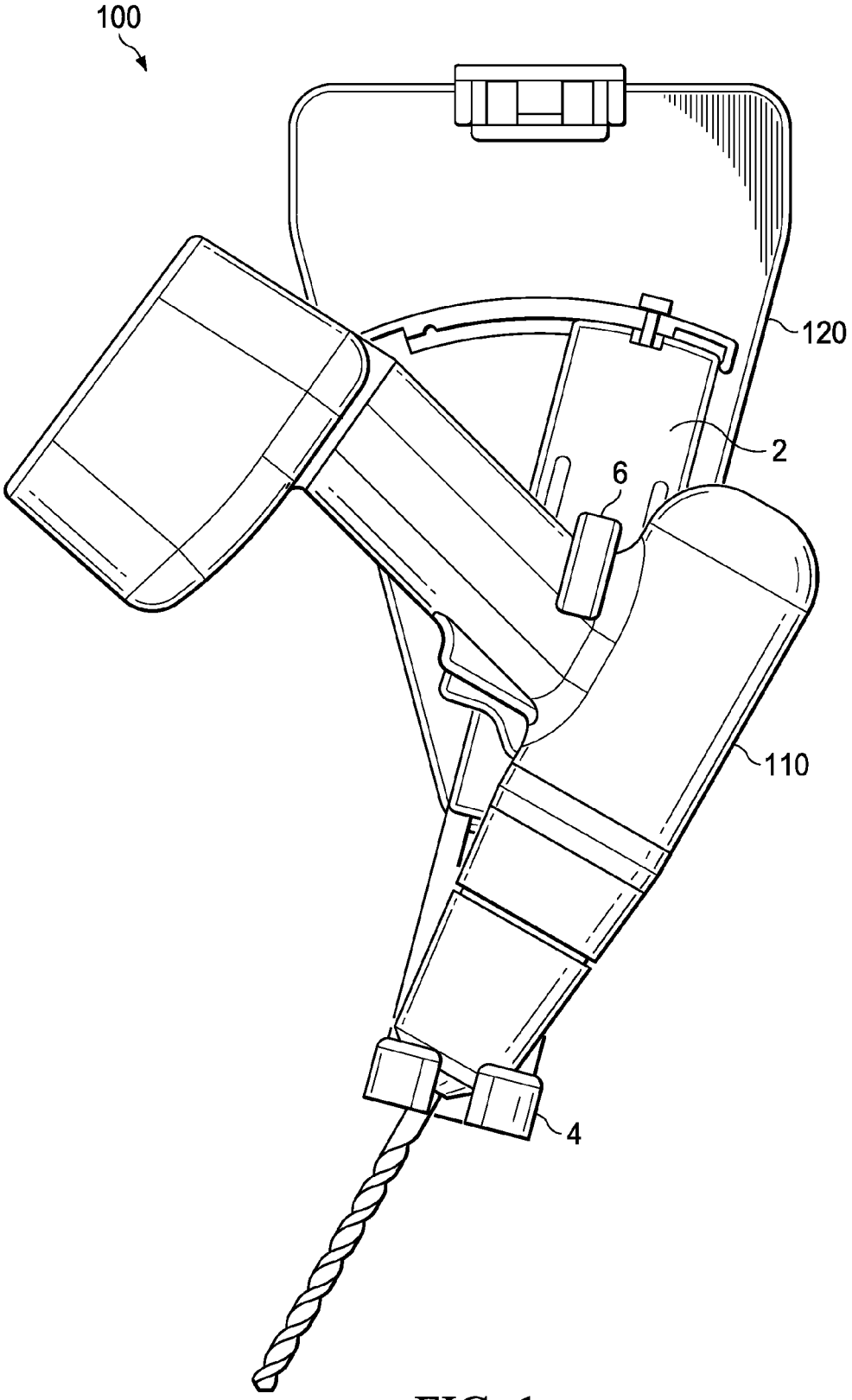
FIG. 1 illustrates an exemplary hand-tool retained within an exemplary holster device, in accordance with the present disclosure.

Referring now to the drawings, wherein the showings are for the purpose of illustrating certain exemplary embodiments only and not for the purpose of limiting the same, FIG. 1 illustrates an exemplary hand-tool retained within an exemplary holster device. Configuration 100 includes holster device 120 and battery powered hand-drill 110. Holster device 120 is configured to be attached to a belt of a worker. Holster device 120 can alternatively be attached to some other surface depending upon the particular attachment feature of holster device 120. In some exemplary conditions, construction workers are known to carry tools around in a large bucket. A spring-loaded clip attachment feature that can be used to attach holster device 120 to a belt may also be used to attach holster device 120 to such a bucket. Holster device 120 includes elastically actuated retention features configured to securely grip and releasably hold drill 110.

Holster device 120 includes a stationary member holding one portion of tool in the holster. Holster device 120 further includes a movable member holding another portion of the tool. The movable member preferably includes a return mechanism, permitting the movable member to be displaced such that the tool can be transitioned to and from the holster device and biasing a position of the movable member to a positing wherein the tool is held securely. In the exemplary embodiment of FIG. 1, the stationary member is embodied by stationary retention hook 6, the movable member is embodied by sliding retention member 4. The return mechanism is embodied an elastic force member within spring housing member 2. Spring housing member 2 is illustrated including one or more springs, which bias the position of the sliding retention member 4 upwards toward drill 110. In this way, the drill is gripped or retained between stationary retention hook 6 and sliding retention member 4. The sliding retention member is configured to secure a bit end of the illustrated pistol grip drill, and the stationary retention hook is configured to secure the portion of the pistol grip that fits between the thumb and index finger of a user.

A holster is configured to securely holds a tool or device to an object, such as the belt of a wearer or to the side of a work bucket or station. The holster is configured to hold the weight of the tool plus some factor of safety. The holster is typically not configured to barely hold the weight of the tool, but rather the holster is configured to more than adequately secure and hold the tool it is configured to hold. Similarly, a wearer is not typically going to carry a tool in a holster so heavy that the wearer can barely hold the tool up. The holster can handle some marginal increase in force applied to the holster in a down direction in addition to the weight of the tool, and the wearer or the structure supporting the tool can handle a marginal increase in force in a down direction in addition to the weight of the tool and the holster. Further, the holster is configured to be stable when a force is pulling down on the holster, such as the force of the weight of the tool. An additional force applied to the holster in the down direction will not destabilize the holster. As a result, a holster can be configured such that a force applied by the user to displace the sliding retention member of the holster disclosed herein, the sliding retention member displacing in a downward direction and the force displacing the sliding retention member acting in a downward direction, acts in a direction that permits the holster to remain stable and is applied in a direction that the wearer or the structure supporting the tool can accept. In this way, the holster disclosed herein permits selective actuation of the sliding retention member to either engage or disengage the tool from the holster, the actuation creating movement in the sliding retention member without destabilizing the holster.

Figure 2:
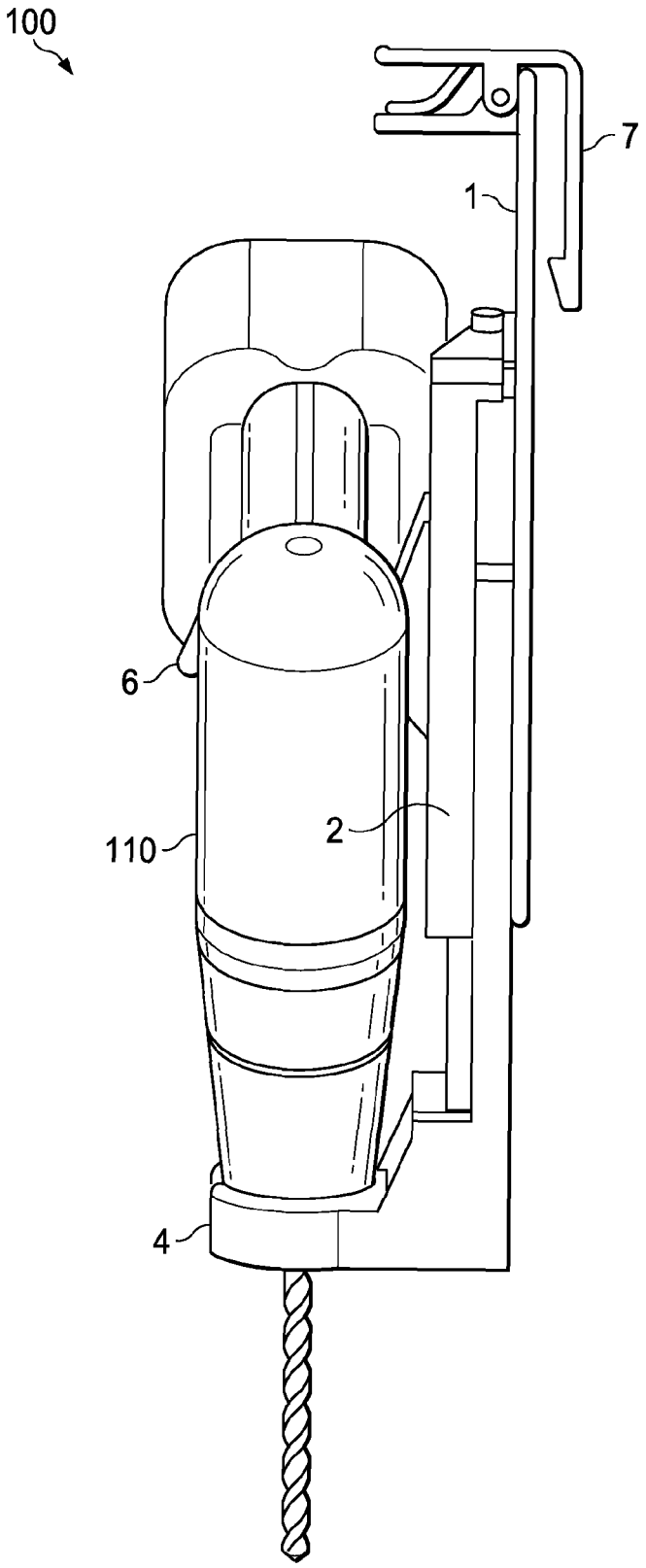
FIG. 2 illustrates the exemplary hand-tool and holster device of FIG. 1 in a side angle, in accordance with the present disclosure.

FIG. 2 illustrates the exemplary hand-tool and holster device of FIG. 1 in a side angle. Drill 110 is illustrated held between an upper stationary retention feature embodied as retention hook 6 of holster device 120 and a sliding retention member 4 of holster device 120. Sliding retention member 4 includes an exemplary retention ring through which an end of drill 110 is inserted. Retention hook 6 is shown engaged to a pistol grip of drill 110 in an area of the pistol grip that is configured to fit between the base of the thumb of a user and the rest of the hand of the user. Sliding retention member 4 is configured to displace in a down direction of the illustration based upon a force applied to sliding retention member 4, for example, as a worker pushes the drill 110 into the retention ring of sliding retention member 4. Sliding retention member 4 can be elastically actuated, with the sliding retention member 4 applying a force against the drill 110 to affix the drill 110 against retention hook 6, according to a number of elastic force members known in the art. In one exemplary embodiment of an elastic force member, a spring or a plurality of springs can be used in compression or tension to provide the elastic actuation. In another embodiment of an elastic force member, an elastic polymer member or members can be used in tension to provide the elastic actuation. Elastic force members provide increasing force upon sliding retention member 4 as the sliding retention member 4 is moved more distant from the stationary retention feature. A number of methods to provide elastic actuation are envisioned, and the disclosure in not intended to be limited to the particular exemplary embodiments provided herein. An exemplary spring housing member 2 of holster device 120 is illustrated, containing an exemplary pair of springs that are compressed as sliding retention member 4 is extended downward. The elastic actuation force that is applied to the drill 110 through sliding retention member 4 must be great enough that the drill 110 can be securely retained to the holster device 120, and the elastic actuation force must be small enough that the worker can release the drill 110 from the holster device 120 without excessive effort. The elastic actuation force can be constant for a particular displacement of the sliding retention member for a particular holster device 120, or the elastic force member can be adjustable or replaceable based upon the mass of the tool or a desired force with which the worker wants the tool to be retained Configuration 100 is illustrated to be configured to a pistol grip tool. It will be appreciated that a stationary retention feature embodied as an alternative cradle feature can be used to cup a back end of a non-pistol grip tool, such as an in-line grinding tool, such that such a tool could be similarly retained by a holster device.

Figure 3:
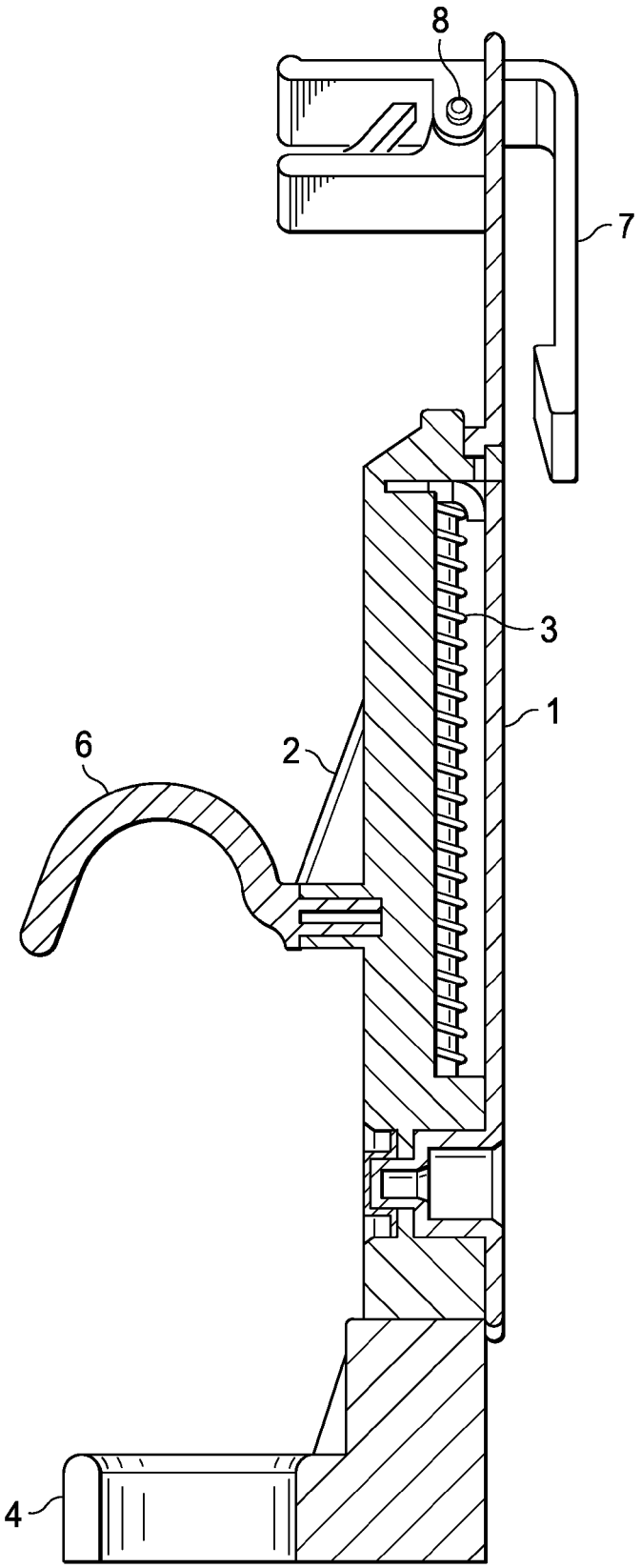
FIG. 3 illustrates an exemplary holster device in cross-section, in accordance with the present disclosure.

FIG. 3 illustrates an exemplary holster device in cross-section. An exemplary illustrated holster device includes a back plate 1, spring housing member 2, spring 3, sliding retention member 4, retention hook 6, spring loaded attachment hook 7, and riveted shaft 8. Spring 3 is configured to be compressed as sliding retention member 4 is extended away from retention hook 6.

Figure 4:
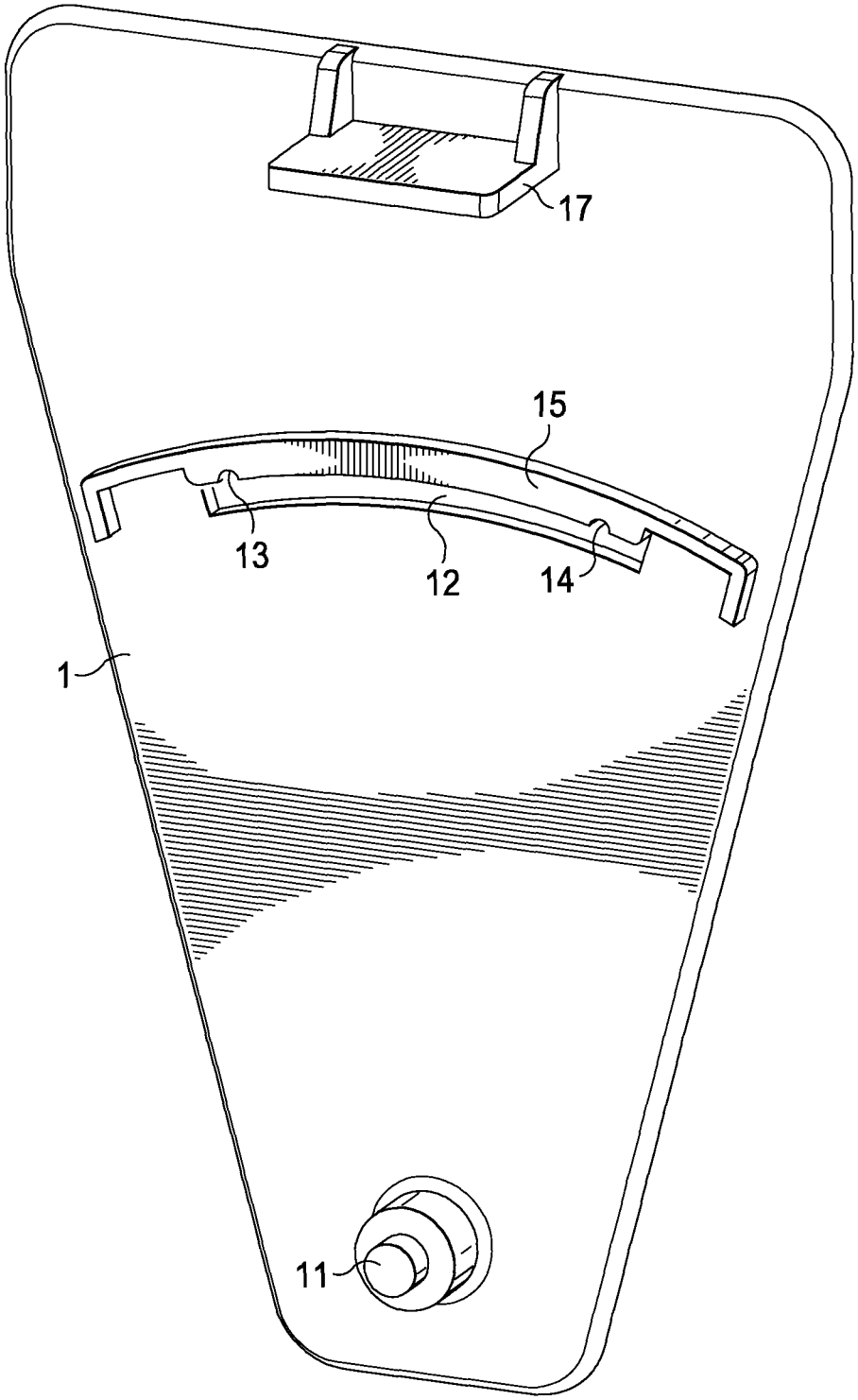
FIG. 4 illustrates an exemplary back plate of a holster device, including a spring loaded belt clip, in accordance with the present disclosure.

FIG. 4 illustrates an exemplary back plate of a holster device, including a spring loaded belt clip. Exemplary back plate 1 is configured with a pivot feature 11 and pivot stop feature 15. A holster device 110 can be configured to be used with a single orientation of the retention features, for example, optimized for use by either a right-handed worker or left-handed worker. In the alternative, adjustable features can be used to permit adjustable orientation of the retention features of the holster device. Pivot feature 11 and pivot stop feature 15 can be utilized with matching features on another member of the holster, such as features upon spring housing member 2, to permit the orientation of the holster device to be changed. Exemplary back plate 1 includes slot 12 to capture via a slide feature of spring housing member 2 and detent features 13 and 14 for robust selection of an orientation of the holster device. Right-handed and left-handed orientations can be configured based upon keeping an approximate center of mass of the drill approximately above the pivot feature 11 to keep the holster and drill as stable as possible. Back plate 1 further includes attachment feature 17.

Figure 5:
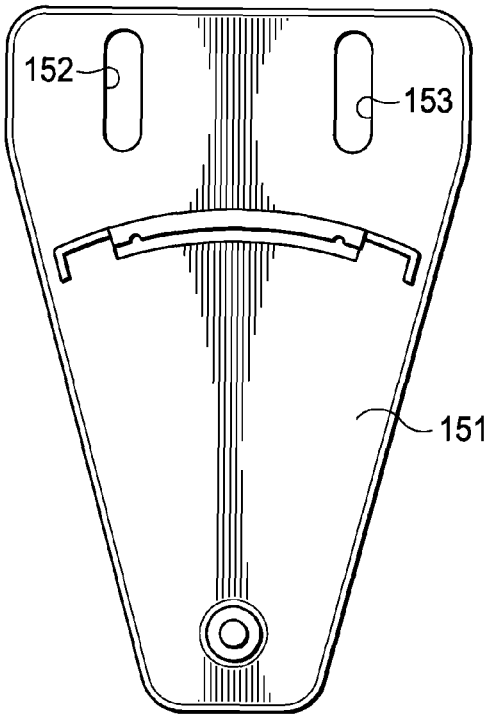
FIG. 5 illustrates an exemplary back plate of a holster device, including a slots for attaching the back plate to a worker's belt, in accordance with the present disclosure.

FIG. 5 illustrates an exemplary back plate of a holster device, including a slots for attaching the back plate to a worker's belt. A number of methods to attach a holster to a belt or other surface are envisioned. Back plate 151 is illustrated including slots 152 and 153 configured to receive a worker's belt threaded therethrough. The disclosure is not intended to be limited to the particular exemplary attachment methods disclosed herein.

Figure 6:
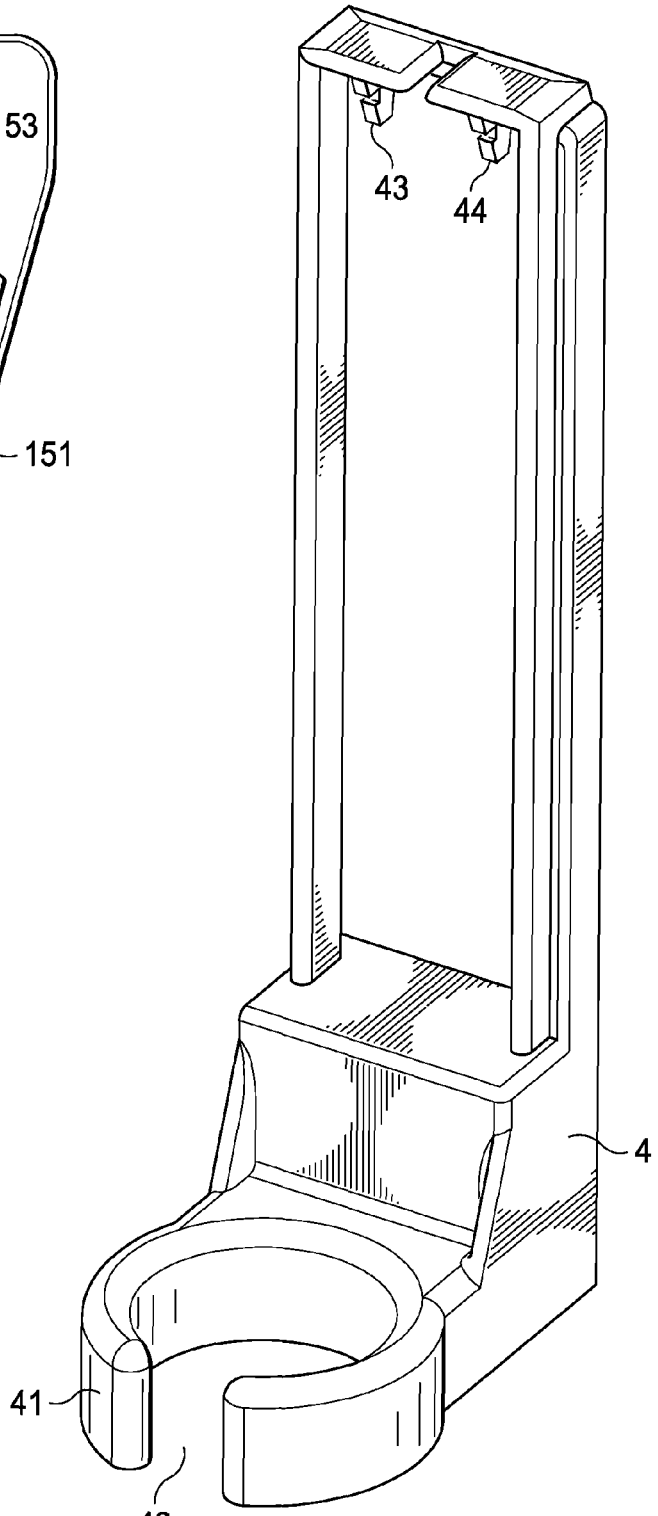
FIG. 6 illustrates an exemplary sliding retention member of a holster device including a slotted retention ring, in accordance with the present disclosure.

FIG. 6 illustrates an exemplary sliding retention member of a holster device including a slotted retention ring. Sliding retention member 4 includes retention ring 41 through which an end of a tool can be inserted for retention of the tool. Retention ring can be a complete ring. In another embodiment, a slotted retention ring 41 is illustrated, with slot 42 configured to permit a shaft of a bit to be inserted through the slot. Drills can use bits with oversized ends that might not fit through a retention ring with a complete ring. For example, a hole saw bit includes a wide ring configured to cut a hole through a door for installation of a door knob. By including slot 42, a drill with a hole saw bit can be retained to the holster.

Sliding retention member 4 includes a pair of spring retention features 43 and 44, such that springs can be encased between a back plate 1, spring housing member 2 and within the rectangular open section of sliding retention member 4. Spring retention features 43 and 44 each hold a first end of a spring and prevent the springs from dislocating during actuation of the holster.

Figure 7:
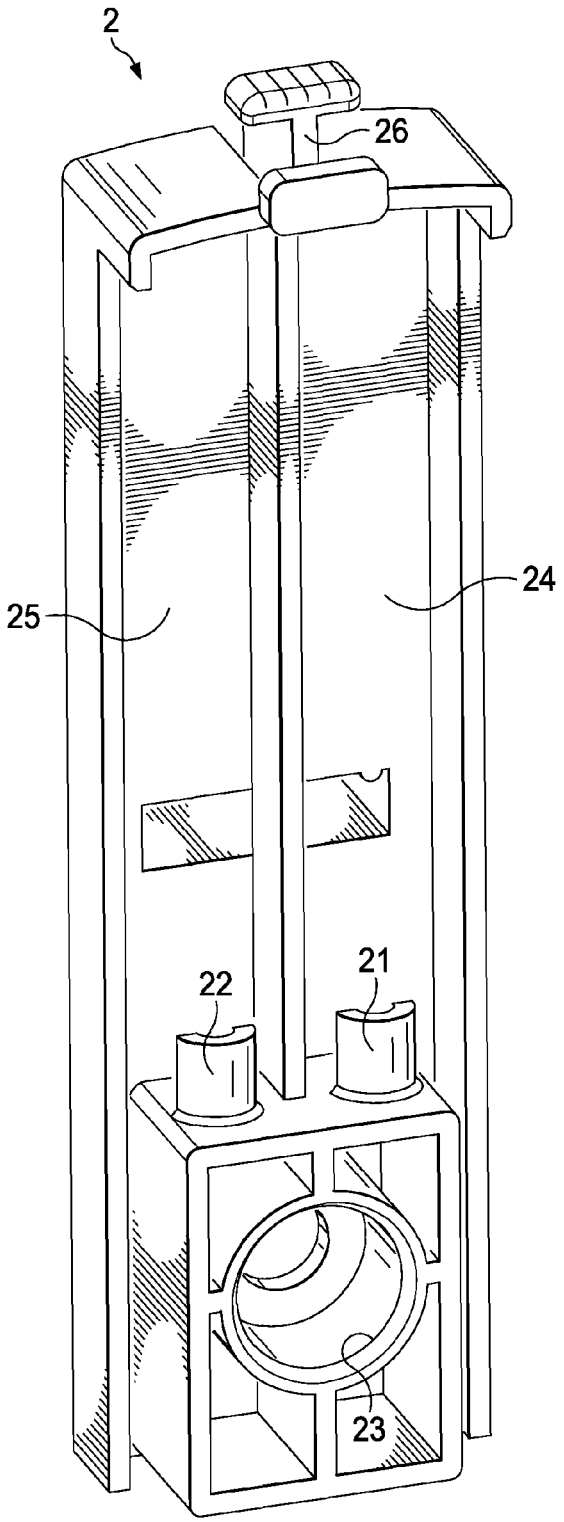
FIG. 7 illustrates an exemplary spring housing member of a holster device, in accordance with the present disclosure.

FIG. 7 illustrates an exemplary spring housing member of a holster device. Spring housing member 2 includes pivot feature hole 23, back plate retention features 26, spring cavities 24 and 25, spring retention features 21 and 22. Pivot feature hole 23 is configured to accept pivot feature 11, and the pivot features can be locked together by a fastener such as a rivet or a screw, or the features can be configured to engage through matching slot features or snap fit features known in the art. Back plate retention features 26 include a tab for fitting within slot 12 and a press tab for engagement and disengagement with detent features 13 and 14 of the back plate 1. Spring cavities 24 and 25 act to maintain the orientation and placement of the springs within the housing. Spring retention features 21 and 22 each hold a second end of a spring, an end opposite to the end held by each of retention features 43 and 44, and prevent the springs from dislocating during actuation of the holster.

Figure 8:
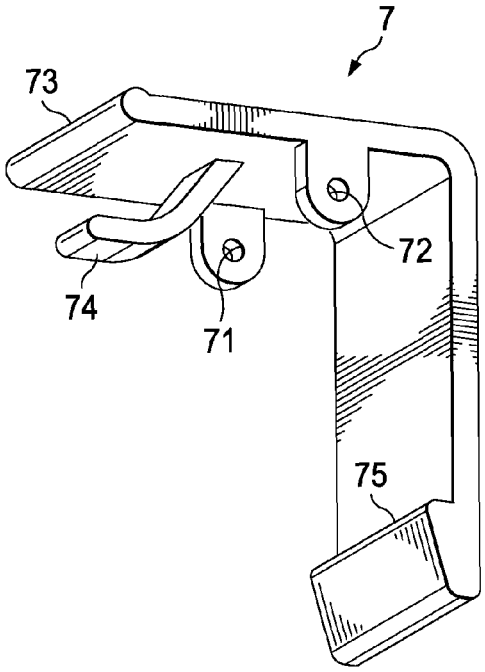
FIG. 8 illustrates an exemplary belt clip member of a holster device, in accordance with the present disclosure.

FIG. 8 illustrates an exemplary belt clip member of a holster device, in accordance with the present disclosure. Belt clip member 7 includes belt gripping member 75, rivet shaft holes 71 and 72, and release tab 73. By pressing down on release tab 73, belt gripping member can be moved and released from a belt. Belt clip member can include a spring or other elastic force member pushing up on release tab 73 to make the belt gripping member 75 normally in a gripping state. Belt clip member 7 includes an elastic feature 74 that provides the upward force on release tab 73. A number of alternative belt clip designs are known in the art, and the holster disclosed herein can be configured to be used with any known belt clip, for example, including any of coil springs, leaf springs, torsion springs, and elastic clips.

The different members of the holster device can be constructed of different materials. Configuration 100 can be made primarily of durable polymers, with the exception of metallic springs and rivets. In the alternative, some of the members can be constructed of metal. In one embodiment, a back plate can be fastened to a leather backer to provide increased durability or comfort for the worker. Thermoformed plastic materials are known in the art that are strong and can be bent without breaking. In one embodiment, many of the pieces of the holster device including the back plate can be made of plastic.

Figure 9:
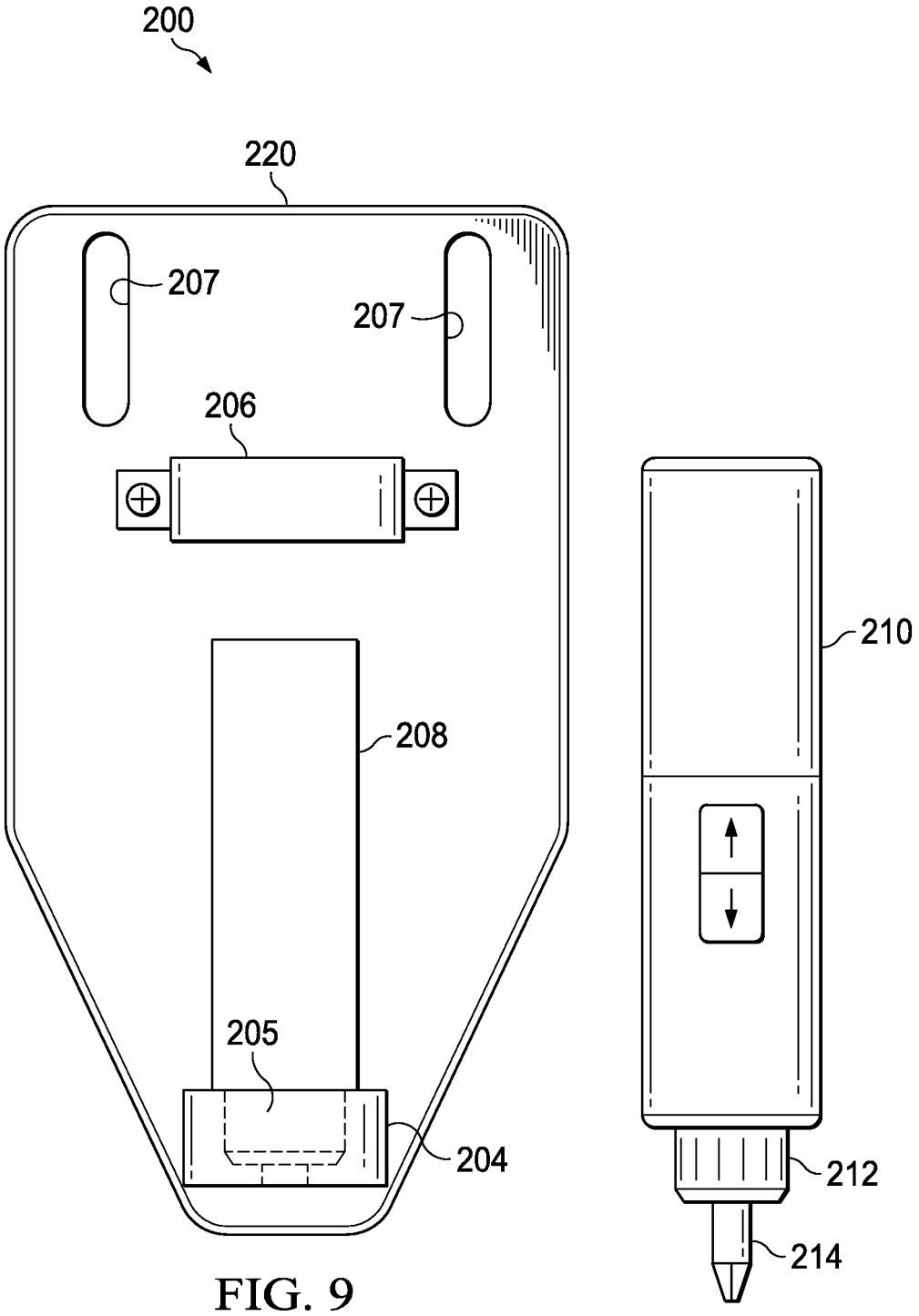
FIG. 9 schematically illustrates an exemplary holster device holding an in-line rotary tool, in accordance with the present disclosure.

FIG. 9 schematically illustrates an exemplary holster device holding an in-line rotary tool. Tool 210 includes a cylindrical body, a chuck end 212, and a tool tip 214. Exemplary holster 200 includes back plate 220, stationary retention feature 206, elastic member housing 208, and sliding retention feature 204. Back plate 220 is constructed of a plurality of layers of leather sewn together. Stationary retention feature 206 is configured to accept a cylindrical end of tool 210. Sliding retention member 204 includes retention ring 205 configured to accept chuck 212 and tool tip 214, such that the end of tool 210 can be pressed into retention ring 205 in order to actuate sliding retention member. Retention ring 205 includes a complete circle, wherein the end of tool 210 including tool tip 214 is short enough that the end of the tool can be slid into retention ring 205 without difficulty. Force applied by the tool user to the tool can be used to briefly displace the sliding retention member to either engage or disengage the tool from the holster. As the force is removed, the sliding retention member 204 returns to its initial position, and a tool between stationary retention feature 206 and retention ring 205 is securely held. Elastic member housing 208 includes a spring or springs, a rubberized elastic member or members, or other elastic features that can permit sliding retention member 204 to displace and can apply a force upon a tool hold between feature 206 and member 204.

Figure 10:
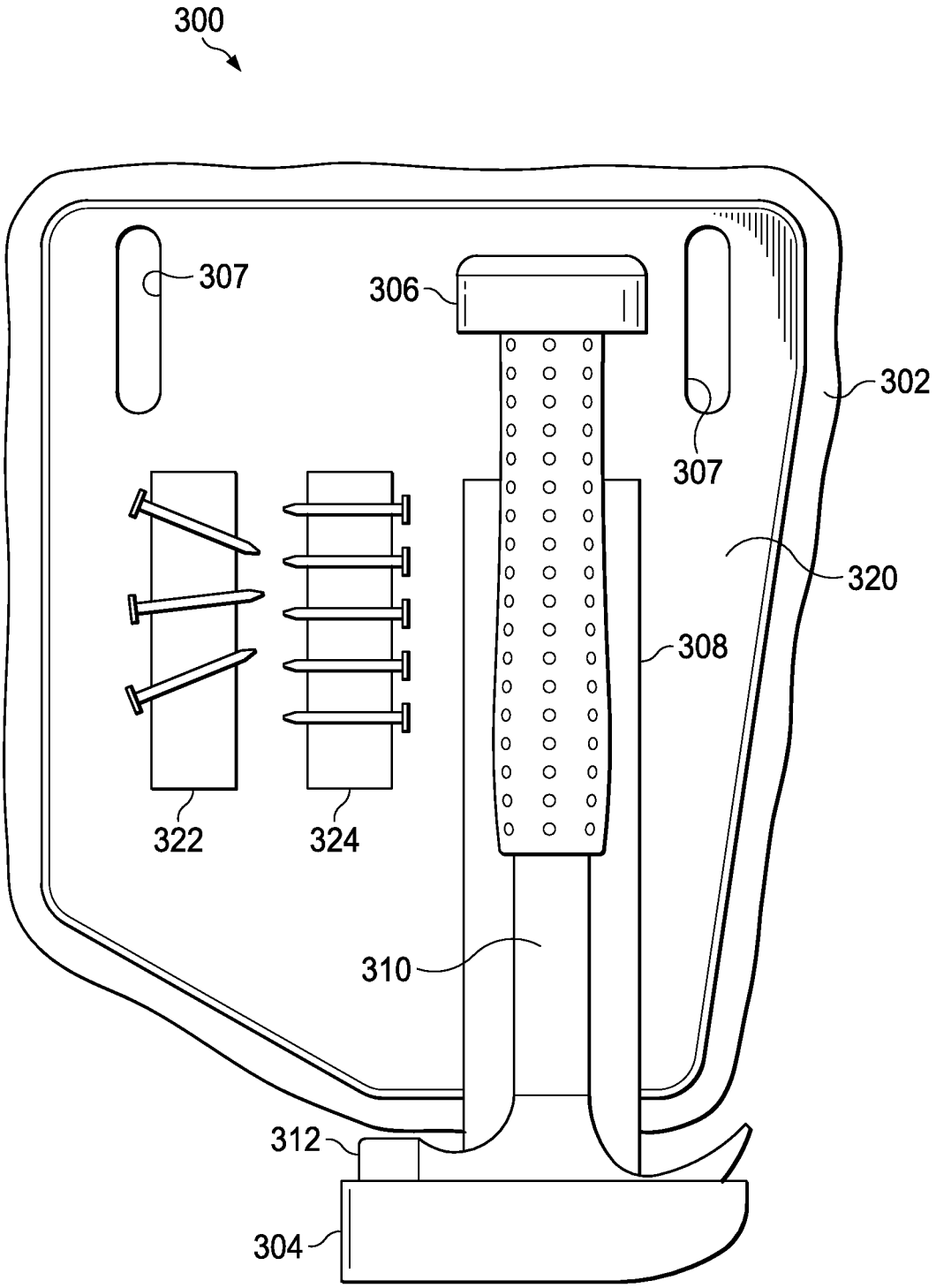
FIG. 10 schematically illustrates an exemplary holster device holding a hammer, in accordance with the present disclosure.

FIG. 10 schematically illustrates an exemplary holster device holding a hammer. Exemplary holster 300 holds hammer 310 and includes back plate 320, stationary retention feature 306, elastic member housing 308, and sliding retention feature 304. Back plate 320 is constructed of a metallic plate, for example, constructed of an aluminum plate. Back plate 320 can include a padding 302 to prevent the aluminum plate from contacting the wearer of the holster. Back plate 320 can include slots 307 to receive a belt of a wearer. Stationary retention feature 306 can include a cavity configured to hold the bottom of a handle of hammer 310. Sliding retention member 304 is configured to hold the head 312 of hammer 310. As a user holding a hammer pushes the head into the matching features of member 304 and applies a downward force, member 304 is displaced. The user then puts the bottom of the hammer handle into feature 306. The return force of a spring or other elastic member within elastic member housing 308 creates a force compressing hammer 310, thereby holding the hammer in place. holster 300 can include magnetic strips 322 and 324 for conveniently holding fasteners in place until needed by the user. While holster 300 holds a hammer, a holster can be used to hold a plurality of tools at one time, for example, with a single holster device holding a pair of pliers, a Phillips head screwdriver, and a straight head screwdriver.

Figure 11:
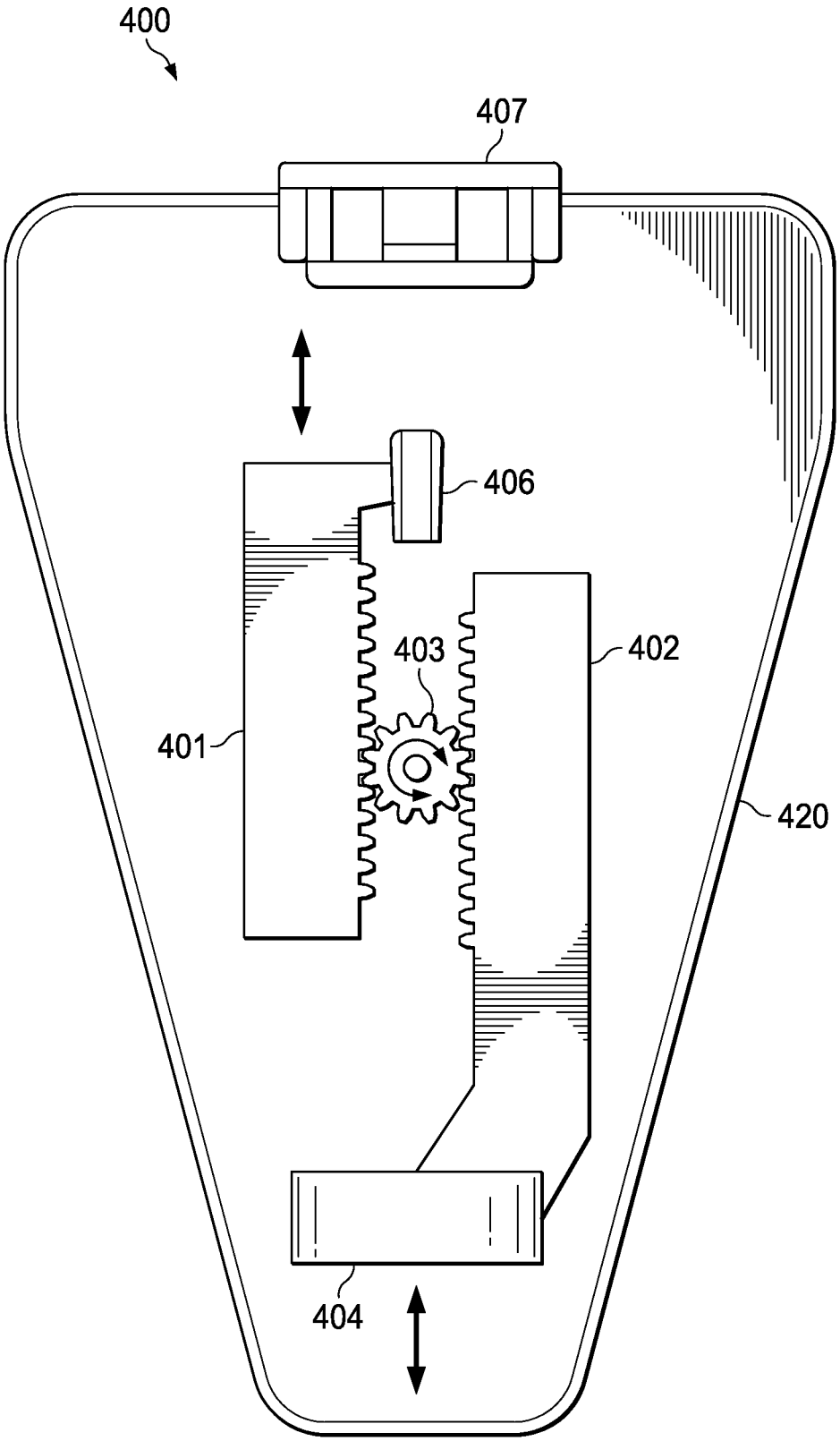
FIG. 11 schematically illustrates an alternative embodiment for a tool retaining holster, in accordance with the present disclosure.

FIG. 11 schematically illustrates an alternative embodiment for a tool retaining holster. Exemplary holster 400 holds a tool between retention hook 406 and retention ring 404 and includes back plate 420. Two elastic member housings 401 and 402 are each connected to a central gear member 403. Elastic member housing 401 includes an exemplary retention hook 406, and elastic member housing 402 includes an exemplary retention ring 404. Gear teeth on central gear member 403 interact with matching teeth on the elastic member housings 401 and 402, such that movement in one of the housings results in a reciprocal motion in the other housing. If a tool is used to push down on retention ring 404, elastic member housing 402 moves down, central gear member 403 moves clock-wise, and elastic member housing 401 and retention hook 406 moves up. Elastic member housing 401, elastic member housing 402, and/or central gear member 403 can include springs or other elastic members to bias the retention hook 406 and retention ring 404 together toward the center of the holster in order to hold a tool as disclosed herein. As force is applied to retention ring 404, the hook and the ring move further apart such that the tool can either be engaged or disengaged from the holster. The holster of FIG. 11 is provided as an example wherein two movable features are used to hold a tool, however, a number of holster configurations are envisioned and the disclosure is not intended to be limited to the examples provided herein.

It will be appreciated that the holster disclosed herein could be used in other fields wherein an object is held in a holster. A clerk working in a checkout lane at a store could keep a scanner or checkout computer in a holster including a sliding retention member and a stationary retention feature as disclosed herein. A police officer could keep a handgun or a flashlight in a holster including a sliding retention member and a stationary retention feature as disclosed herein. A number of embodiments of holster application are envisioned, and the disclosure is not intended to be limited to the particular examples provided herein.

An apparatus for securely holding a tool can be described to include a holster device. The holster device can include a stationary retention feature and a sliding retention member securing a first portion of the tool and pressing a second portion of the tool against the stationary retention feature. The tool is retained to the holster device between the stationary retention feature and the sliding retention member. The holster device can be configured such that a force applied to the tool moves the sliding retention member away from the stationary retention feature and releases the tool from the holster device.

The stationary retention feature is configured to hold a portion of the tool and receive a force applied to the feature by the tool, with the force being applied in the direction that the sliding retention member moves. As illustrated in the figures, the stationary retention feature can be a hook oriented to oppose the force applied by the tool to the feature or a cup shaped feature configured to the specific tool. These shapes are intended as non-limiting examples of shapes that can be used for the stationary retention feature. Any shape that can secure the portion of the tool being pressed against the feature may be used, and the disclosure is not intended to be limited to the particular examples provided herein.

A method to selectively retain a tool to a holster can include providing a stationary retention feature at a fixed position on the holster device, securing one portion of the tool with a sliding retention member, and using force from an elastic force member to push the tool against the stationary retention feature to secure a second portion of the tool. In this way, the tool is retained to the holster device between the stationary retention feature and the sliding retention member. The method can include engaging to the tool to the holster device by locating a bit end of the tool to a retention ring of the sliding retention member, applying force through the tool to the sliding retention member to move the sliding retention member away from the stationary retention feature locating the second portion of the tool to the stationary retention feature, and removing the applied force to permit the elastic force member to push the tool against the stationary retention feature. The method can also include disengaging to the tool from the holster device by applying force through the tool to the sliding retention member to move the sliding retention member away from the stationary retention feature, disengaging the second portion of the tool from the stationary retention feature, and removing the applied force to permit the sliding retention member to return to an unloaded position.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Apparatus for retaining a battery powered pistol grip tool configured to provide torque to a bit, the apparatus comprising:

the battery powered pistol grip tool comprising:

a chuck holding the bit; and a pistol grip depression on the pistol grip tool distal from the chuck;

a retention device comprising:

a base portion configured to be mounted in a vertical direction;

a stationary retention feature comprising a hook-shaped feature resting in the pistol grip depression and a vertical portion attached to the hook-shaped feature;

a sliding retention member comprising a ring-shaped retention feature accepting the chuck within the ring-shaped retention feature; and a spring force member providing a force upon the sliding retention member in a direction toward the stationary retention feature;

wherein the vertical portion of the stationary retention feature defines a first longitudinal axis;

wherein the bit in the chuck defines a second longitudinal axis; and wherein the second longitudinal axis differs from the first longitudinal axis by an angle greater than zero degrees.

2. The apparatus of claim 1, wherein the sliding retention member is located below the stationary retention feature.

3. The apparatus of claim 1, wherein the ring-shaped retention feature comprises:

an inner diameter upon an inside surface of the feature;

an outer diameter upon an outside surface of the feature; and an opening spanning the inner diameter and the outer diameter, the opening being configured to permit a shaft of the bit to be slid through the opening.

4. The apparatus of claim 1, wherein the spring force member comprises a plurality of springs acting upon the sliding retention member.

5. The apparatus of claim 1, wherein the spring force member comprises an elastic member acting upon the sliding retention member.

6. The apparatus of claim 1, wherein the pistol grip tool comprises a pistol grip drill.

7. The apparatus of claim 1, wherein base portion comprises a plastic back plate.

8. The apparatus of claim 1, wherein the retention device further comprises a pivot feature to permit use by a right-handed worker and use by a left-handed worker.

9. Apparatus for retaining a battery powered pistol grip drill configured to provide torque to a bit, the apparatus comprising:

the battery powered pistol grip drill comprising:

a chuck holding the bit; and a pistol grip depression on the pistol grip drill distal from the chuck;

a holster retention device comprising:

a base portion configured to be mounted in a vertical direction;

a stationary retention feature comprising a hook-shaped feature resting in the pistol grip depression;

a sliding retention member comprising a ring-shaped retention feature accepting the chuck within the ring-shaped retention feature; and a spring force member providing a force upon the sliding retention member in a direction toward the stationary retention feature;

wherein the stationary retention feature defines a first longitudinal axis;

wherein the bit in the chuck defines a second longitudinal axis;

wherein the second longitudinal axis is farther from the vertical direction than the first longitudinal axis by an angle greater than zero degrees; and wherein the ring-shaped retention feature comprises:

an inner diameter upon an inside surface of the feature;

an outer diameter upon an outside surface of the feature; and an opening spanning the inner diameter and the outer diameter, the opening being configured to permit a shaft of the bit to be slid through the opening.

10. The apparatus of claim 9, wherein the spring force member comprises a pair of springs.

* * * * *